US007845630B2

(12) United States Patent
Hung et al.

(10) Patent No.: US 7,845,630 B2
(45) Date of Patent: Dec. 7, 2010

(54) SHEET FEEDING DEVICE

(75) Inventors: Che-Pin Hung, Hsinchu (TW); Shao-Yang Wu, Hsinchu (TW); Wen-Sheng Liu, Hsinchu (TW)

(73) Assignee: Foxlink Image Technology Co., Ltd., Hsinchu (TW)

( * ) Notice: Subject to any disclaimer, the term of this patent is extended or adjusted under 35 U.S.C. 154(b) by 244 days.

(21) Appl. No.: 12/137,954

(22) Filed: Jun. 12, 2008

(65) Prior Publication Data

US 2009/0309293 A1 Dec. 17, 2009

(51) Int. Cl.
*B65H 3/52* (2006.01)
*B65H 1/08* (2006.01)
*B65H 3/60* (2006.01)

(52) U.S. Cl. ..... 271/121; 271/126; 271/133

(58) Field of Classification Search ..... 271/126, 271/131, 133, 165, 167, 121
See application file for complete search history.

(56) References Cited

U.S. PATENT DOCUMENTS 3,838,851 A * 10/1974 Kolibas ..... 271/124
4,284,269 A * 8/1981 Ignatjev ..... 271/122
4,346,879 A * 8/1982 Ruenzi ..... 271/121
4,568,074 A * 2/1986 Murayoshi ..... 271/121
4,667,244 A * 5/1987 Ishikawa ..... 358/498
4,674,737 A * 6/1987 Murayoshi ..... 271/124
4,887,806 A * 12/1989 Tanaka et al. ..... 271/121
5,083,766 A * 1/1992 Osawa ..... 271/121
5,570,876 A * 11/1996 Samii ..... 271/119
5,573,338 A * 11/1996 Morikawa et al. ..... 400/611
6,010,126 A * 1/2000 Mou et al. ..... 271/121
6,575,453 B2 * 6/2003 Chiang ..... 271/124
6,956,679 B2 * 10/2005 Hatano ..... 358/474

FOREIGN PATENT DOCUMENTS

JP 59043741 * 3/1984
JP 63262352 * 10/1988
JP 04140233 * 5/1992
JP 06227694 * 8/1994

* cited by examiner

*Primary Examiner*—Stefanos Karmis
*Assistant Examiner*—Patrick Cicchino
(74) *Attorney, Agent, or Firm*—Muncy, Geissler, Olds & Lowe, PLLC

(57) ABSTRACT

A sheet feeding device includes a pick roller and a resilient element disposed above the pick roller. The pick roller has a roller surface. The resilient element includes two side resilient arms and a center resilient arm located between the two side resilient arms. Free ends of the two side resilient arms are pushed forward by all sheets when the sheets arrive between the free ends of the two side resilient arms and the roller surface. A free end of the center resilient arm faces the roller surface of the pick roller and maintains a gap therebetween. When too many pieces of paper are drawn forward to the resilient element, the side resilient arms are pushed forward further more, the uppermost paper contacts the center resilient arm. The center resilient arm cooperates with the side resilient arms to provide the paper a pressure big enough to be conveyed forward.

3 Claims, 8 Drawing Sheets

SHEET FEEDING DEVICE

BACKGROUND OF THE INVENTION

1. Field of the Invention

This present invention relates to a sheet feeding device applicable to an office device such as a printer, a copier and a scanner, and more particularly to a sheet feeding device capable of ensuring the reliability of sheet feeding.

2. The Related Art

With reference to FIG. 1, a common sheet feeding device includes a pick roller 120 and a resilient element 160. The resilient element 160 includes two resilient arms 161 extending and bending rearward from two ends of the resilient element 160. Before paper feeding, the tips of the resilient arms 161 contact the curved surface of the pick roller 120. In operation, the leading ends of the paper sheets push free ends of the resilient arms 161 and then enter between the resilient arms 161 and the pick roller 120. The resilient arms 161 exert a pressure on the paper between the resilient arms 161 and the pick roller 120, which ensures the frictional engagement of the paper with the pick roller 120. With the rotation of the pick roller 120, the paper is drawn forward.

However, once the resilient element 160 is made, the resilient force provided by the resilient arms 161 is limited to be a fixed range. When the resilient force of the resilient arms 161 is unduly large, a few pieces of paper can hardly push away the resilient arms 161 to enter between the pick roller 120 and the resilient arms 161. In a contrary case, when the resilient force of the resilient arms 161 is too small, too many pieces of paper will be able to enter between the pick roller 120 and the resilient arms 161, which will cause malfunction of an office device coupled with the paper feeding component. In other words, the frictional force applied between the paper and the pick roller 120 is not large enough to convey the paper forwardly. So the resilient force provided by the resilient arms 161 is difficult to being confirmed, the accuracy of the sheet feeding is uncertain.

SUMMARY OF THE INVENTION

Accordingly, an object of the invention is to provide a sheet feeding device to enhance the reliability of sheet feeding.

To achieve the object, the sheet feeding device includes a pick roller and a resilient element disposed above the pick roller. The pick roller has a roller surface. The resilient element includes two side resilient arms and a center resilient arm located between the two side resilient arms. Free ends of the two side resilient arms are pushed forward by all sheets when the sheets arrive between the free ends of the two side resilient arms and the roller surface. A free end of the center resilient arm faces the roller surface of the pick roller and maintains a gap therebetween.

As described above, when a few pieces of paper are conveyed to the resilient element, the resilient force of the side resilient arms is small enough for the leading ends of the paper pushing forward the side resilient arms. When too many pieces of paper are conveyed to the resilient element, the side resilient arms are pushed further more and the center resilient arm contact an uppermost paper. The center resilient arm exerts a pressure to cooperate with the side resilient arms to ensure that the frictional force between the paper and the pick roller is big enough for conveying the paper forward. So the sheet feeding device of the present invention enhances the reliability of the sheet feeding.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

We define the conveying direction of the paper as a front direction.

Figure 1:
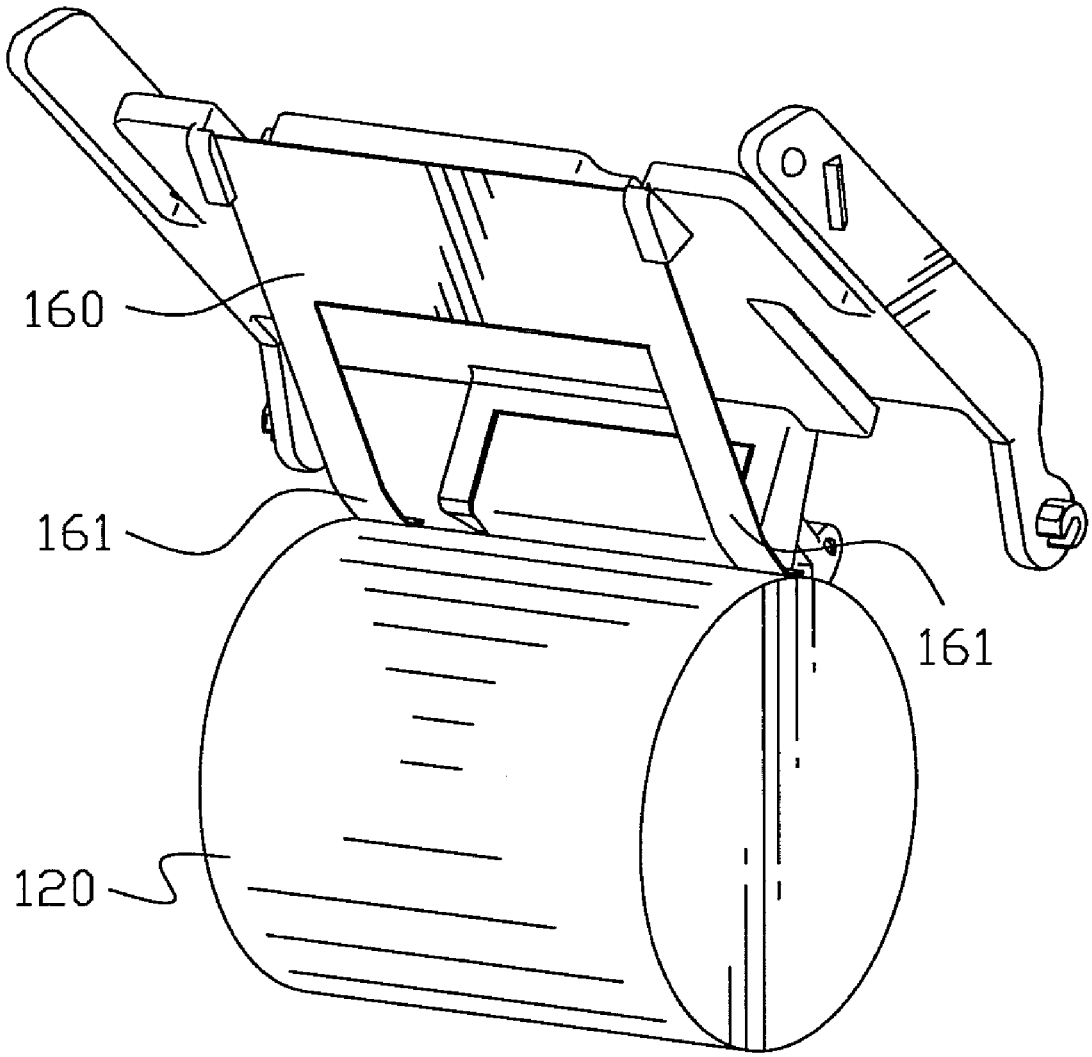
FIG. 1 (Prior Art)
FIG. 1 is a perspective view of a conventional sheet feeding device.
Figure 2:
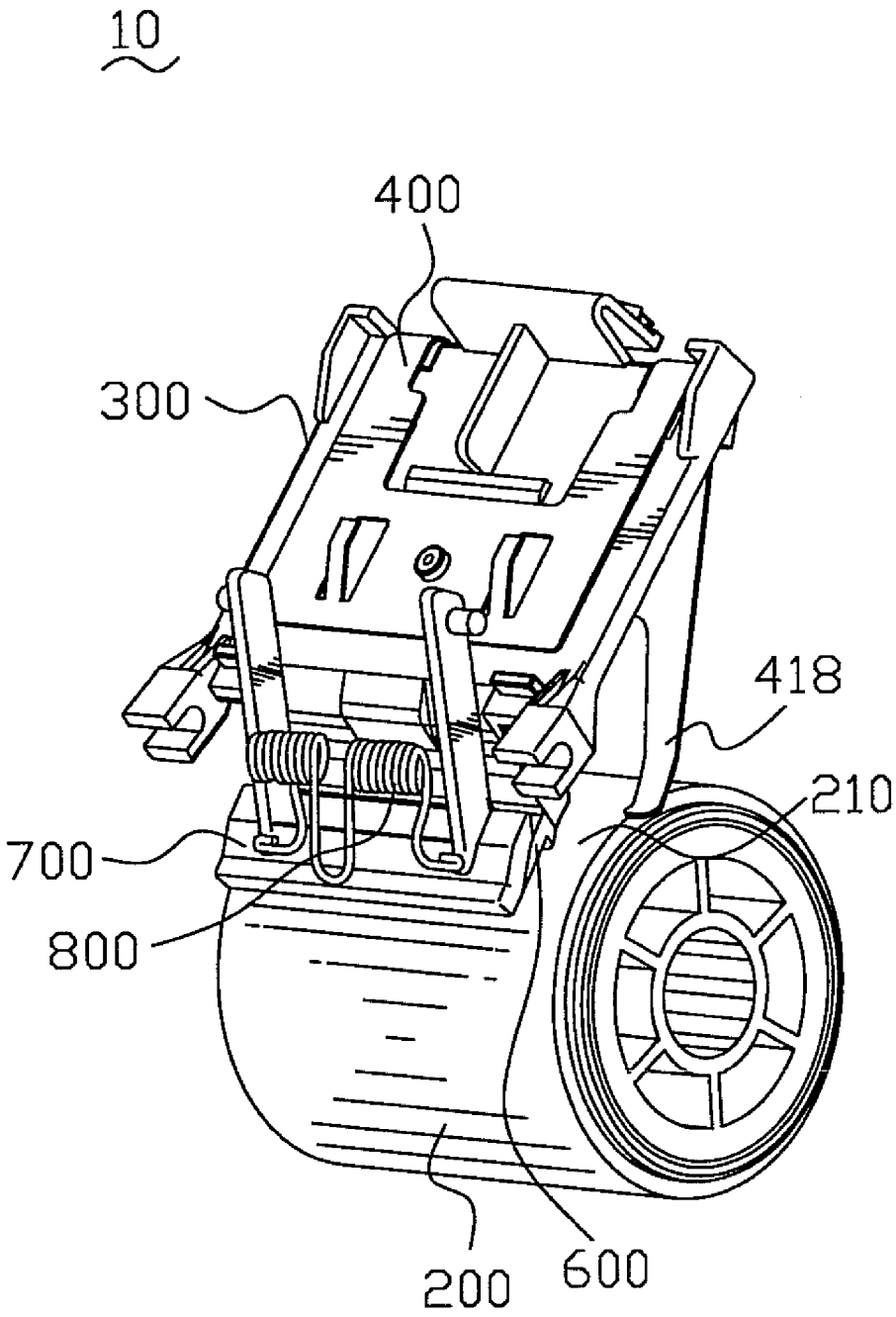
FIG. 2 is a perspective view of a sheet feeding device according to the present invention.
Figure 3:
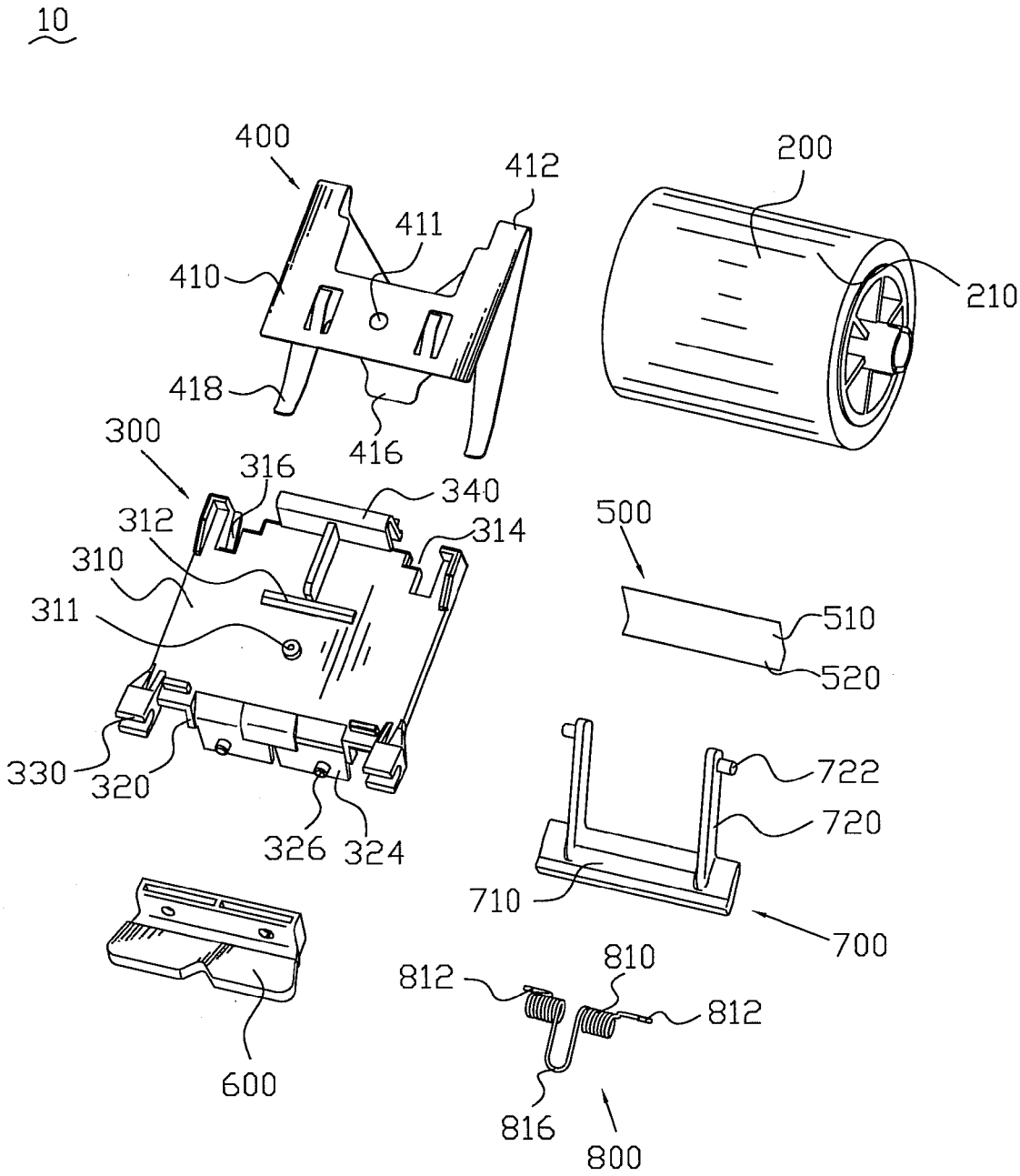
FIG. 3 is an exploded view of the sheet feeding device in FIG. 2.

Referring FIGS. 2 and 3, a sheet feeding device 10 includes a pick roller 200, a bracket 300, a resilient element 400, a press pad 500, a separator pad 600, a press plate 700 and a torsion spring 800. The pick roller 200 has a roller surface 210 of a substantially cylindrical shape.

Figure 4:
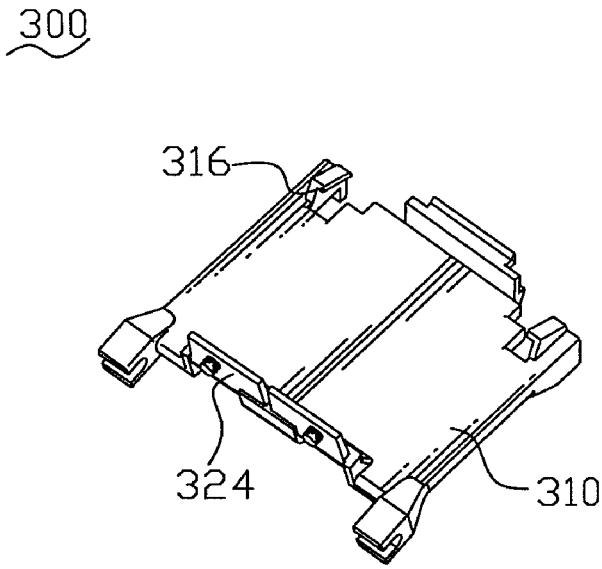
FIG. 4 is a perspective view of a bracket of the sheet feeding device of FIG. 3.

In FIGS. 2, 3 and 4, the bracket 300 has a rectangular support board 310. A first location peg 311 and a block 312 project upward from the surface of the support board 310 respectively. Two ends of the bottom of the support board 310 extend forward to form a pair of first fixing portions 330 with a U-shaped space therein. The middle of the bottom of the support board 310 bends and extends downward to form a prop board 320. The bottom surface of the prop board 320 extends to form two rectangular retaining boards 324 abreast. Each retaining board 324 defines a second location peg 326 on a front surface thereof. The middle of the top of the support board 310 extends upward and bends rearward to form a second fixing portion 340. The first fixing portions 330 and the second fixing portion 340 are provided to fix the bracket 300 to an upper frame (not shown) of an office device. Two clipping slots 314 are defined in the support board 310 and respectively adjacent to two sides of the second fixing portion 340. Two retainers 316 extend rearward and bend inward from two sides of the support board 310 and adjacent to outsides of the two clipping slots 314.

Figure 5:
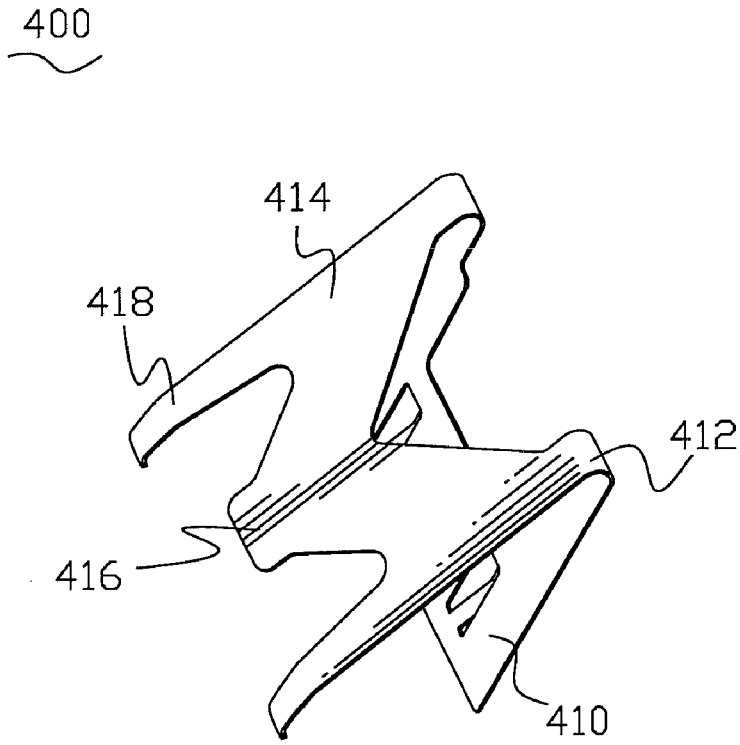
FIG. 5 is a perspective view of a resilient element of the sheet feeding device of FIG. 3.
Figure 6:
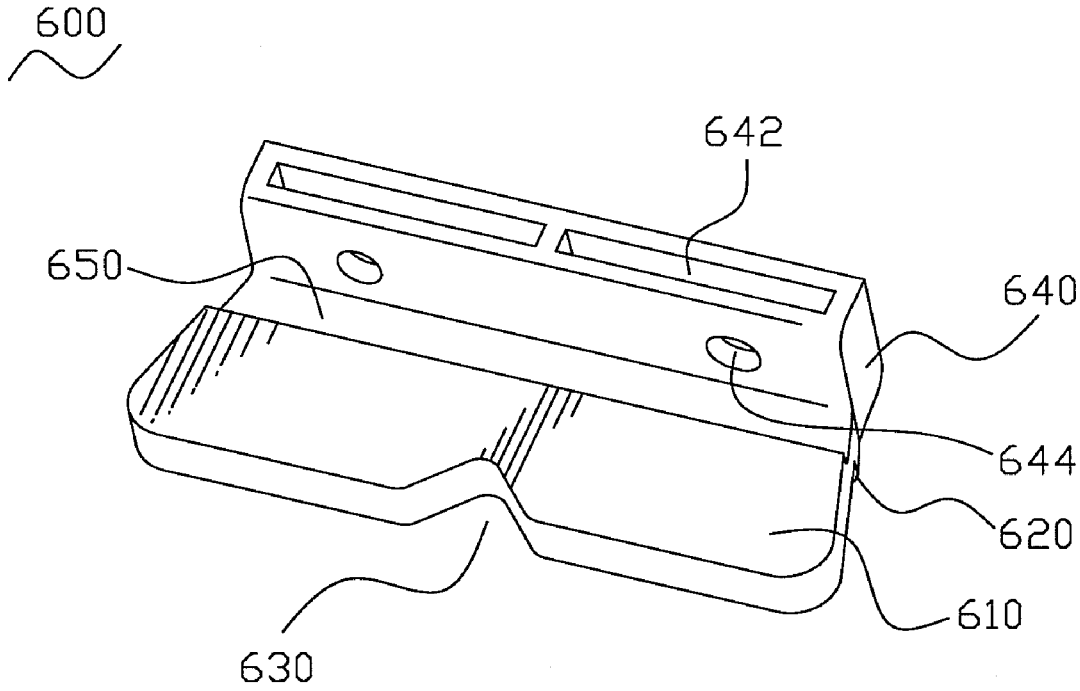
FIG. 6 is a perspective view of a separator pad of the sheet feeding device of FIG. 3.
Figure 7:
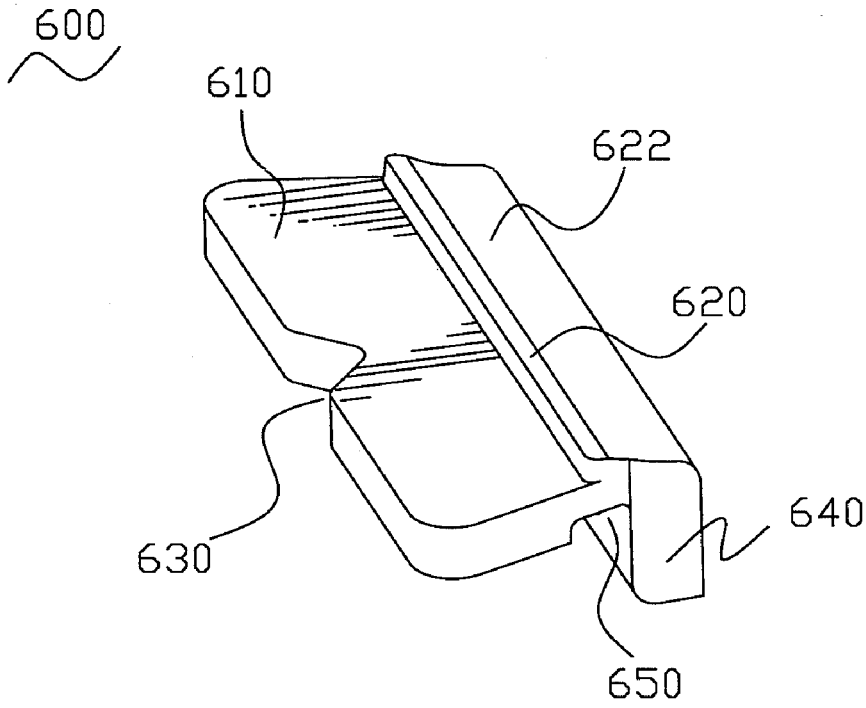
FIG. 7 is another perspective view of the separator pad of the sheet feeding device.

Referring to FIGS. 2, 3 and 5, the resilient element 400 has a holding portion 410. A location hole 411 is defined in the holding portion 410 for mating with the location peg 311 to fix the holding portion 410 on the support board 310 of the bracket 300. A top of the holding portion 410 resists the block 312 to further fix the holding portion 410 on the support board 310. Two ends of the top of the holding portion 410 extend upward and bend downward to form a pair of clipping portions 412. The two clipping portions 412 are retained into the two clipping slots 314 of the bracket 300 and supported by the two retainers 316 respectively. The retainers 316 are provided to resist the elastic deformation of the clipping portions 412. The two clipping portions 412 further extend downward and inward to form an integral resilient prop board 414. The middle of the resilient prop board 414 protrudes downward to form a center resilient arm 416 and two ends of the resilient prop board 414 extend downward to form two side resilient arms 418 with a hooked tip bent forward. A free end of the center resilient arm 416 faces the roller surface 210 of the pick roller 200 and maintains a small gap therebetween. Free ends of the side resilient arms 418 contact the roller surface 210 of the pick roller 200.

With reference to FIG. 3, the press pad 500 includes a pad holder 510 and a pad press portion 520 bending and extending forward from a bottom of the pad holder 510. The pad holder 510 is fixed in backside of the prop board 320 of the bracket 300. The pad press portion 520 is placed in front of the side resilient arms 418. A free end of the pad press portion 520 faces the roller surface 210 of the pick roller 200. A small gap is formed between the free end of the pad press portion 520 and the roller surface 210 of the pick roller 200.

Figure 10:
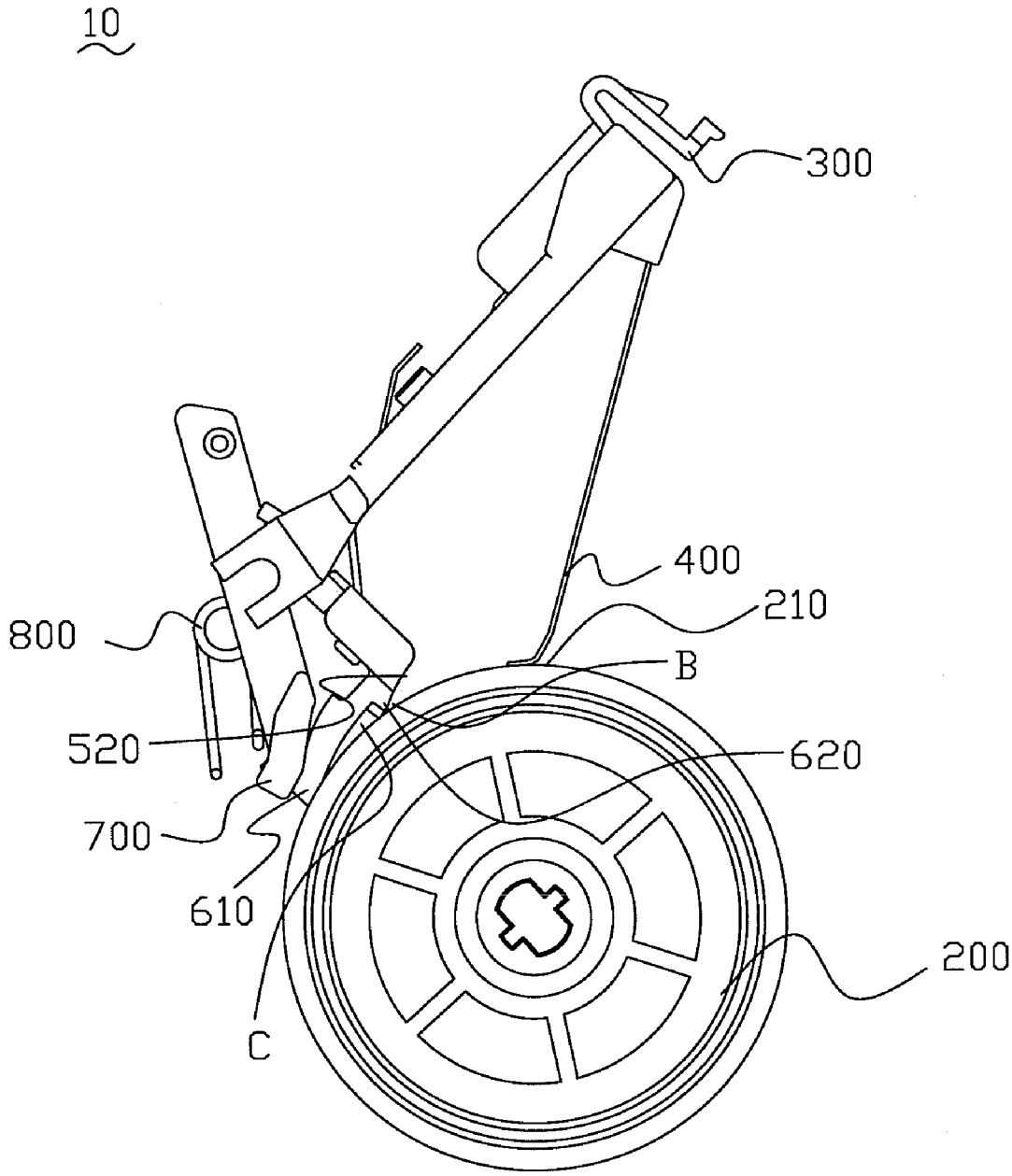
FIG. 10 is an elevational side view of the sheet feeding device in FIG. 2.

In FIGS. 2, 3, 6 and 7, the separator pad 600 is placed in front of the press pad 500. The friction coefficient of the separator pad 600 is larger than that of the paper sheets and smaller than that of the pick roller 200. The separator pad 600 has a substantially rectangular first rubbing portion 610. The front section of the first rubbing portion 610 facing the pick roller 200 contacts the roller surface 210 of the pick roller 200. A region C shown in FIG. 10 is formed between the rear section of the first rubbing portion 610 and the roller surface 210 of the pick roller 200. The rear end of the first rubbing portion 610 protrudes downward to form a second rubbing portion 620 with a ramp 622 on a bottom thereof. The front section of the ramp 622 of the second rubbing portion 620 contacts the roller surface 210 of the pick roller 200. A region B shown in FIG. 10 is formed between the rear section of the ramp 622 and the roller surface 210 of the pick roller 200. The maximum height of the region B is equal to a total height of ten pieces of paper of 70 grams per square meter. An indentation 630 of a triangular shape is formed on an end of the first rubbing portion 610 opposite to the second rubbing portion 620 for smoothing a crumpled paper sheet inserted between the first rubbing portion 610 and the pick roller 200. An elastic groove 650 is formed on an upper surface of the first rubbing portion 610 near the second rubbing portion 620 to enhance the elasticity of the separator pad 600 for the first rubbing portion 610 contacting the pick roller 200 more closely. The rear end of the separator pad 600 protrudes upward to form a rectangular fixing board 640. Two fixing grooves 642 are defined on the fixing board 640 abreast. A fixing hole 644 is defined on the side wall of each fixing groove 642 near the elastic groove 650. The two retaining boards 324 of the bracket 300 are received in the two fixing grooves 642 respectively and the two second location pegs 326 are inserted into the two fixing holes 644 respectively for fixing the separator pad 600 on the bracket 300.

With reference to FIG. 3, the press plate 700 includes a plate portion 710 of a block shape and two connecting bars 720 protruded upward from two ends of the plate portion 710. The plate portion 710 presses on the upper surface of the first rubbing portion 610 of the separator pad 600. A free end of each connecting bar 720 protrudes outward to form a pivot 722. The two pivots 722 are pivotally mounted to the upper frame.

Figure 8:
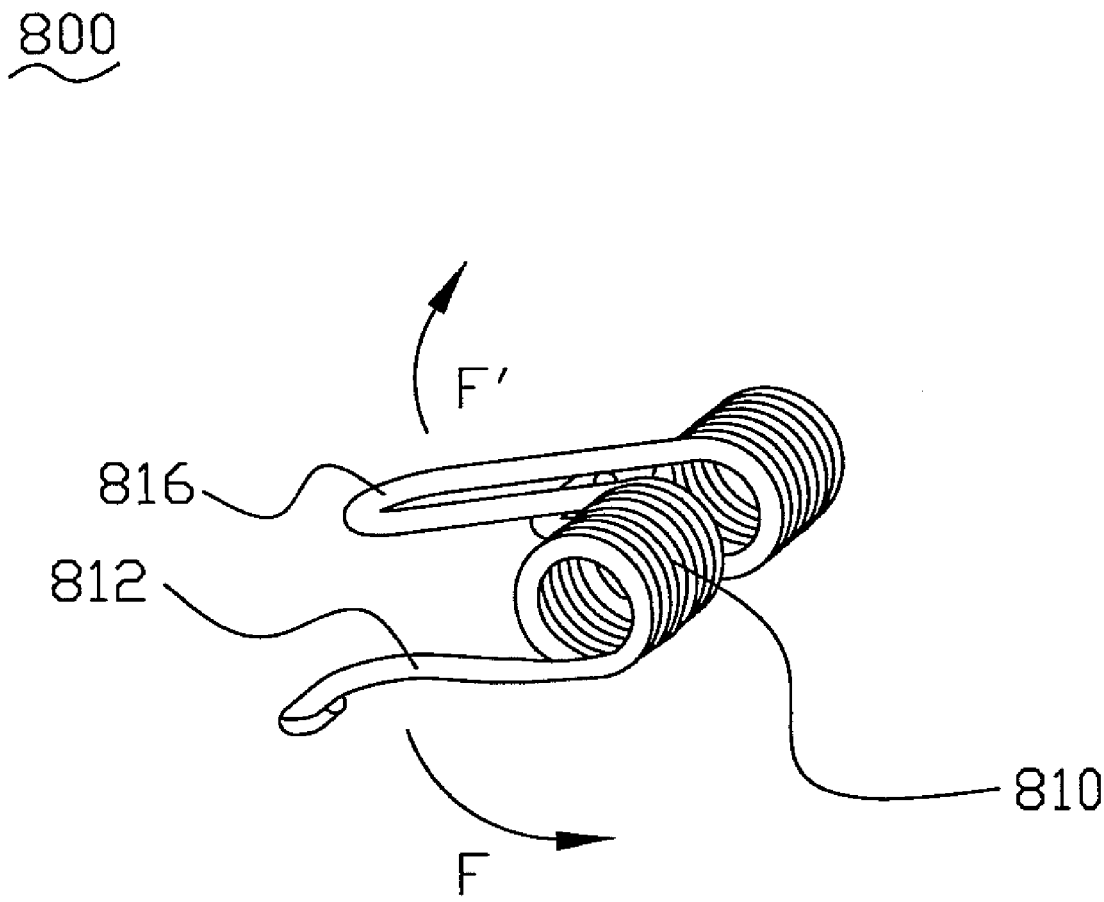
FIG. 8 is a perspective view of a distorted status of the torsion spring of the sheet feeding device of FIG. 3.

In FIGS. 3 and 8, the torsion spring 800 includes two helical-shaped torsion portions 810 arranged transversely and a U-shaped connecting portion 816 connecting the two torsion portions 810. The connecting portion 816 presses on the surface of the plate portion 710 of the press plate 700. The outer side of each torsion portion 810 extends and bents outward to form a retaining arm 812 of an L-shaped. The two retaining arms 812 resist the junction of the plate portion 710 and the connecting bars 720.

When the sheet feeding device 10 is assembled, the torsion portions 810 of the torsion spring 800 are deformed. The retaining arms 812 and the connecting portion 816 respectively produce force F' and force F as showing in FIG. 8. The force F produced by the retaining arms 812 makes the plate portion 710 of the press plate 700 press the first rubbing portion 610 and the second rubbing portion 620 closely to the roller surface 210 of the pick roller 200.

Figure 9:
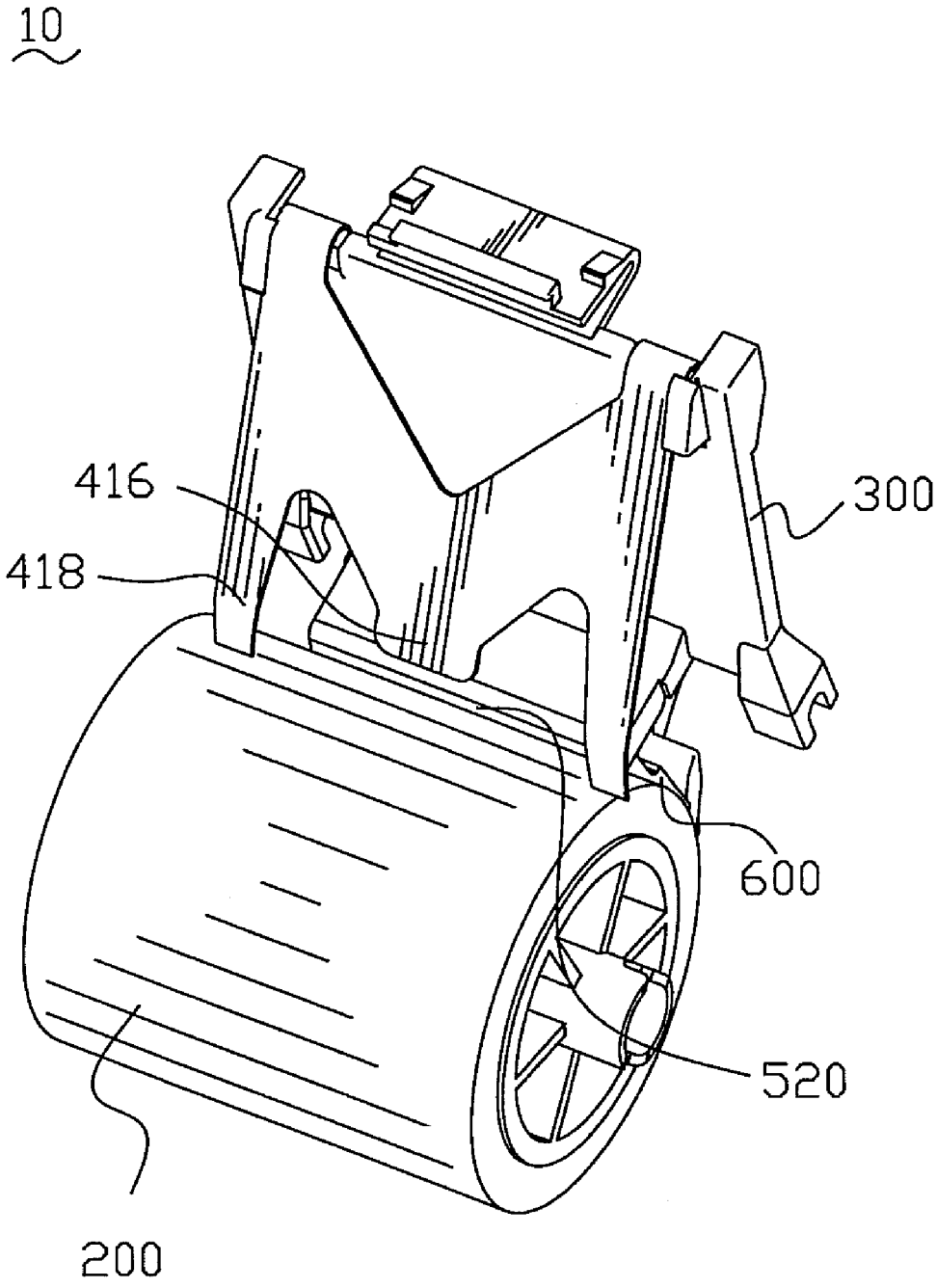
FIG. 9 is another perspective view of the sheet feeding device.

With reference to FIGS. 9 and 10, in a preferred embodiment, the resilient force provided by the side resilient arms 418 is small enough to allow only one piece of paper push forward the side resilient arms 418. When a few pieces of paper are drawn forward along with the rotation of the pick roller 200 due to their own weight, the leading ends of the paper sheets only push forward the side resilient arms 418 of the resilient element 400 and enter between the pick roller 200 and side resilient arms 418. When too many pieces of paper are drawn forward with the rotation of the pick roller 200 to insert between the side resilient arms 418 and the pick roller 200, the side resilient arms 418 are pushed further more, the uppermost paper contacts the center resilient arm 416. The center resilient arm 416 cooperates with the side resilient arms 418 to provide the paper a pressure big enough to be conveyed forward.

The pad press portion 520 of the press pad 500 presses the paper sheets to prevent them from curling. The lowermost paper and several pieces of paper thereon move to the region B between the second rubbing portion 620 of the separator pad 600 and the pick roller 200. The ramp 622 of the second rubbing portion blocks some pieces of paper from being further conveyed and due to the friction of the second rubbing portion 620, only one to three pieces of paper can be conveyed to the region C. When the paper sheets are inserted into the region C, due to the friction of the first rubbing portion 610, only the lowermost paper can pass through the first rubbing portion 610 and the pick roller 200 to insert the office device.

According to the sheet feeding device 10 of the present invention as described above, when a few pieces of paper are conveyed to the resilient element 400, the resilient force of the side resilient arms 418 is small enough for the leading ends of the paper to be forwarded to the side resilient arms 418. When too many pieces of paper are to be conveyed to the resilient element 400, the side resilient arms 418 are pushed further more and the center resilient arm 416 contacts the uppermost paper. The center resilient arm 416 exerts a pressure to cooperate with the side resilient arms 418 to ensure that the frictional force between the paper and the pick roller 200 is big enough for the paper being conveyed forward. So the sheet feeding device 10 according to the present invention enhances the reliability of the sheet feeding.

An embodiment of the present invention has been discussed in detail. However, the embodiment is merely specific examples for clarifying the technical contents of the present invention and the present invention is not to be construed in a restricted sense as limited to the specific examples. Such modifications and variations that may be apparent to those skilled in the art are intended to be included within the scope of this invention as defined by the accompanying claims.

What is claimed is:

1. A sheet feeding device, comprising:

a pick roller having a roller surface; and a resilient element disposed above the pick roller, the resilient element having two side resilient arms and a center resilient arm located between the two side resilient arms, free ends of the two side resilient arms being pushed forward by all sheets when the sheets arrive between the free ends of the two side resilient arms and the roller surface, a free end of the center resilient arm facing the roller surface of the pick roller and maintaining a gap therebetween, and a bracket arranged above the pick roller, the bracket defusing a support board, the resilient element having a holding portion mounted to the support board;

wherein two ends of the holding portion of the resilient element extend and bend downward to form a pair of clipping portions, the two clipping portions further extend downward and inward to form an integral resilient prop board, and the two side resilient arms and the center resilient arm extend downward from the resilient prop board.

2. A sheet feeding device comprising:

a pick roller having a roller surface; and a resilient element disposed above the pick roller, the resilient element having two side resilient arms and a center resilient arm located between the two side resilient arms, free ends of the two side resilient arms being pushed forward by all sheets when the sheets arrive between the free ends of the two side resilient arms and the roller surface, a free end of the center resilient arm facing the roller surface of the pick roller and maintaining a gap therebetween; and a separator pad, the separator pad having a first rubbing portion and a second rubbing portion protruding downward from an rear end of the first rubbing portion, an front end of the first rubbing portion and an front end of the second rubbing portion contacting the roller surface of the pick roller for cooperating with the pick roller to separate a lowermost one of the sheets, wherein the first rubbing portion defines an indentation in an end of the first rubbing portion opposite to the second rubbing portion for smoothing a crumpled paper sheet inserted between the first rubbing portion and the pick roller.

3. A sheet feeding device comprising:

a pick roller having a roller surface; and a resilient element disposed above the pick roller, the resilient element having two side resilient arms and a center resilient arm located between the two side resilient arms, free ends of the two side resilient arms being pushed forward by all sheets when the sheets arrive between the free ends of the two side resilient arms and the roller surface, a free end of the center resilient arm facing the roller surface of the pick roller and maintaining a gap therebetween; and a separator pad, the separator pad having a first rubbing portion and a second rubbing portion protruding downward from an rear end of the first rubbing portion, an front end of the first rubbing portion and an front end of the second rubbing portion contacting the roller surface of the pick roller for cooperating with the pick roller to separate a lowermost one of the sheets, wherein the first rubbing portion protrudes upwardly to form a fixing board opposite to the second rubbing portion, the fixing board defines at least one fixing groove at a top thereof, the sheet feeding device further comprises a bracket arranged above the pick roller, and the bracket has at least one retaining board inserted in the fixing groove for fixing the separator pad to the bracket.

* * * * *